US006730165B2

(12) United States Patent
Emery et al.

(10) Patent No.: US 6,730,165 B2
(45) Date of Patent: May 4, 2004

(54) POLYMER IMPREGNATION PROCESS

(75) Inventors: Clair John Emery, Baton Rouge, LA (US); Charles Martin Shields, Golden Meadow, LA (US)

(73) Assignee: Tembec USA LLC, St. Francisville, LA (US)

( * ) Notice: Subject to any disclaimer, the term of this patent is extended or adjusted under 35 U.S.C. 154(b) by 25 days.

(21) Appl. No.: 10/113,740

(22) Filed: Apr. 1, 2002

(65) Prior Publication Data

US 2003/0185987 A1 Oct. 2, 2003

(51) Int. Cl.[7] ..... B05C 1/04

(52) U.S. Cl. ..... 118/67; 118/68; 118/69; 118/602; 118/641; 118/58; 118/60; 427/428

(58) Field of Search ..... 118/641, 58, 60, 118/67, 68, 69, 602; 427/428, 374.1

(56) References Cited

U.S. PATENT DOCUMENTS

| | | | | |
|---|---|---|---|---|
| 2,829,980 A | | 4/1958 | Redd | |
| 3,015,577 A | | 1/1962 | Sacher | |
| 3,076,720 A | | 2/1963 | Rice | |
| 3,200,008 A | | 8/1965 | Holtschmidt | |
| 3,320,086 A | | 5/1967 | Rose | |
| 3,677,868 A | | 7/1972 | Boggs | |
| 3,702,781 A | | 11/1972 | Dahl | |
| 4,391,833 A | | 7/1983 | Self | |
| 4,407,690 A | | 10/1983 | White | |
| 4,618,530 A | | 10/1986 | Stetson | |
| 5,225,140 A | | 7/1993 | Hayashikoshi | |
| 5,401,899 A | * | 3/1995 | Bryant et al. | 118/603 |
| 5,578,344 A | | 11/1996 | Ahr | |
| 5,654,039 A | | 8/1997 | Wenzel | |
| 5,827,616 A | | 10/1998 | Girard | |
| 6,113,981 A | | 9/2000 | Olgilvie, Jr. | |
| 6,193,831 B1 | | 2/2001 | Overcash | |

* cited by examiner

*Primary Examiner*—Laura Edwards
(74) *Attorney, Agent, or Firm*—Russel O. Primeaux; Kean, Miller, Hawthorne, D'Armond, McCowan & Jarman LLP

(57) ABSTRACT

A device for impregnating a paper web with a molten polymer to produce a paper with improved resistance to oil and grease are provided. The device includes, as part of an on-machine process, an ordinary paper web composed of cellulose or synthetic fibers, a polymer applicator, a hot reel, and a winding reel. The web, which is created through a series of processes located upstream of the subject invention, first encounters the polymer applicator, which deposits a quantity of molten polymer onto the surface of the web. The web is next transferred to a hot reel, which maintains the temperature of the molten polymer above its melting point and thereby facilitates wicking of the molten polymer into the web. After the web passes the hot reel, it is wound onto a winding reel, where additional wicking occurs until the molten polymer cools to a temperature below its melting point. The invention further includes a method for impregnating a web of fibers and a polymer impregnated paper with improved resistance to oil and grease, produced by the described method.

25 Claims, 3 Drawing Sheets

POLYMER IMPREGNATION PROCESS

CROSS-REFERENCE TO RELATED APPLICATION

Not applicable.

BACKGROUND OF THE INVENTION

1. Field of the Invention

This invention relates, generally, to the manufacturing of polymer impregnated specialty papers, and particularly to a method and device for impregnating a cellulose web with a molten polymer.

2. Description of Related Art

The growth of the fast food industry over the past several decades has been matched by an increase in the demand for paper products that are associated with fast food items, such as beverage cups, coffee filters, paper wrappers, and paper food containers. These paper products are fashioned from specially engineered papers ("specialty papers"), which are produced to suit both the commercial needs of fast food vendors as well as the domestic needs of families in their homes. Among these specialty papers, food wrappers comprise a generous portion of the food paper market.

Food wrappers are traditionally made from waxed paper, which may be imprinted with the name or logo of the vendor whose product is being sold. Waxed paper is commonly used to wrap various food items, including, among others, sandwiches, tacos, gyros, french fries, biscuits, onion rings, popcorn, and chicken tenders. Unfortunately, the ability of most waxed paper food wrappers to resist grease or oil is marginal at best, especially when the grease or oil is hot. In fact, if grease or oil, whether hot or cold, is allowed to remain in contact with food grade waxed paper for any substantial length of time, the grease or oil will penetrate the paper and come into contact with the hands, clothing, or surroundings of the user.

Therefore, there exists a need for an improved paper food wrapper that has improved resistance to oil and grease emanating from the food that is contained in the wrapper, while at the same time retaining flexibility and the ability to receive printed material on its surface. More importantly, the improved paper food wrapper needs to be inexpensive and easy to manufacture. In order to keep production costs at a minimum, the paper from which the improved food wrappers are generated should be manufactured as part of a continuous on-machine process, rather than a batch process, which consumes more time and resources.

Preferably, the device and process for making an improved food wrapper should be located at the end of a traditional paper manufacturing process as an additional and optional step in the specialty paper production process. The total process should flow as a single manufacturing operation without interruption from the time the paper web is formed from pulp fibers to the time the paper web encounters the finishing process that imparts superior oil and grease resistant qualities to the web. The process should not require the manufacturer to stop the machine before the paper web completes the finishing process. Moreover, the device should be quick and simple to operate, should eliminate unnecessary steps, and should not require the manufacturer to dedicate substantial time or resources to the production effort.

In the art of manufacturing specialty papers, a cellulose or synthetic paper web may be treated with various compounds to improve certain characteristics of the paper that is treated, including strength, durability, printability, and resistance to water, oil, grease, and ultraviolet radiation. One such compound that can be applied to paper is paraffin wax.

Waxed paper is produced in a number of ways, including the application of a paraffin film to a paper web using a mechanical roller. The paper produced by this particular method is a wax "coated" paper. The term "coated" is used to describe this process because the paraffin film is in contact with only one side of the paper web and the depth of penetration of the wax into the paper fibers is only superficial.

Polymers that are capable of withstanding higher temperatures than paraffin have also been applied to a cellulose paper web using a method known as extrusion. In the extrusion method, a polymer is heated to a semi-solid state and then pushed through a die to form a semi-solid film, which is then fed into a nip where the film is pressed against a paper web. The features of the coated paper generated using this method are similar to those of wax coated paper, although the polymer coated paper may have better resistance to grease penetration.

While papers treated using the extrusion method may have certain advantages over wax coated papers, they still have inferior resistance to oil and grease due to the fact that the extruded material does not permeate throughout the paper, but adheres to only one side. Therefore, if the untreated side is exposed to grease or other liquid, the cellulose fibers will be weakened and the structural integrity of the paper product will be compromised. While extruded layers could be applied to both sides of a paper web, the process would be expensive and difficult to achieve at a commercial level. Moreover, introducing an additional layer would add unwanted weight, rigidity, and bulk to a paper product that is intended to be light, flexible and thin in order to conform to the shape of the food around which it is wrapped. Finally, even if the grease, oil, or other liquid contact the side of the paper containing the extruded material, the integrity of the extruded barrier may be compromised by the breaking of the film that commonly occurs when such paper is creased or folded.

The extrusion method is also inferior because it requires the use of sophisticated precision equipment. The material that is to be extruded must be heated to a temperature that is high enough to transform the material from a solid state to a pliable, semi-solid state. However, the temperature of the extruder should not be so high as to make the material a flowable liquid, which would be incapable of forming the film that is ultimately applied to the paper web. In addition, once the optimum temperature is achieved, the semi-solid material must be pushed through a die at a rate of speed sufficient to match the rate of speed at which the extruded film is pressed against the web. In practice, the extrusion method has proven difficult to implement in an on-machine process, where the web encounters the extruded film at a high rate of speed.

Another method of treating paper in order to improve grease resistance and durability is the impregnation method. In this method, a molten liquid compound is applied to a cellulose or synthetic web. The molten compound permeates the web and adheres to the individual cellulose or synthetic fibers. The paper produced by this method is superior to papers with wax film or extruded layers, which merely bond to the surface of the web and do not coat the fibers beneath the surface of the paper.

The impregnation method has been used exclusively in connection with the application of resinous compounds or aqueous polymeric dispersions (formed when a polymer is mixed with water). The disadvantage of using these resinous or aqueous compounds to impregnate a paper web is that each compound requires a subsequent processing step before the paper product may be stored on a winding reel. Resinous compounds must be allowed to cure over a period of time. The curing process may also involve the application of heat. After an aqueous polymeric dispersion is applied to a paper web, the product must undergo a drying period, in which the water must be evaporated away from the polymeric compound. This evaporation usually occurs in a drying step. Both of these secondary processing steps consume time and resources, and consequently reduce output volume and increase the price of the finished product.

What is needed is a polymer impregnation process and device for carrying out the process that overcome the shortfalls of the processes and devices that are currently known in the art.

OBJECTS OF THE INVENTION

It is an object of the present invention to provide a device for impregnating a cellulose paper web with a molten polymer.

Another object of the present invention is to provide a device for impregnating a cellulose paper web with a molten polymer that produces a polymer impregnated paper with superior resistance to grease.

Another object of the present invention is to provide a device for impregnating a cellulose paper web with a molten polymer that can be efficiently utilized as an on-machine process, rather than as a batch process.

Another object of the present invention is to provide a device for impregnating a cellulose paper web with a molten polymer that eliminates the need for a subsequent drying or curing step.

Another object of the present invention is to provide an on-machine method for impregnating a cellulose paper web with a molten polymer.

Another object of the present invention is to provide a polymer impregnated paper obtained by the method described hereinafter.

SUMMARY OF THE INVENTION

A device and method for impregnating a paper web with a molten polymer are provided. The device and method utilize a scientific phenomenon known as "wicking" to penetrate or "impregnate" a web of cellulose fibers with a polymer that has been heated to a molten state. Wicking, which is the process by which a liquid permeates a fibrous web and adheres to the individual fibers, can vary in degree, depending on the temperature, viscosity, and surface tension of the penetrating liquid. As a general rule, the longer the penetrating liquid remains above its melting point, the greater the degree of wicking that occurs. Once the liquid cools to a temperature below its melting point, the liquid begins to solidify and wicking ceases. Of course, some substances require curing or drying beyond the mere solidification of the substance, but these steps are unnecessary in the present invention.

The device includes, as part of an on-machine process, an ordinary paper web composed of cellulose or synthetic fibers (along with any additives such as clays, dyes, fillers and other substances common in the art), a polymer applicator, a hot reel, and a winding reel. The web, which is created through a series of processes located upstream of the subject invention, first passes over the polymer applicator, where an applicator roller, part of which is immersed in a molten polymer bath, deposits a quantity of molten polymer onto the surface of the web. After the molten polymer has been applied by the polymer applicator, the web passes an optional distributing means, which evenly distributes the molten polymer onto the surface of the web and removes any excess polymer.

The web is next transferred to a hot reel, which is a metal drum heated to a temperature sufficient to maintain the molten polymer above its melting point. Because the polymer is maintained in liquid state while being applied to the web and during the time for which it is in contact with the hot reel, significant wicking of the polymer into the web occurs.

After the web passes the hot reel, it is transferred to a winding reel, where the paper web is wound and stored for further processing or shipment. For a period of time after the web is transferred to the winding reel, the polymer remains in a molten state and will continue to wick throughout the web. Once the polymer cools below its melting point, wicking will cease and the process is complete.

Depending on the temperatures of the various process components, the user can select the degree of wicking preferred. A higher temperature will maintain the temperature of the polymer above its melting point for a longer period of time and thereby produce a paper with fibers that are completely permeated and coated with polymer. A lower temperature will produce a paper with fibers that are minimally coated or superficially coated to a minimal depth.

An alternative embodiment of the invention includes replacing the hot reel with a cold reel or cold rolls to reduce the temperature of the molten polymer after application and to control the degree of wicking.

Another embodiment of the invention includes varying the respective velocities of the applicator roller and the web in order to increase or decrease the amount of polymer that is deposited on the web.

Another embodiment of the invention includes the addition of guide rollers to increase or decrease the amount of surface contact that the web has with the applicator roller and the hot reel.

Another embodiment of the invention includes a polymer applicator with a polymer recirculation means.

Another embodiment of the invention includes a polymer applicator that is capable of simultaneously depositing molten polymer onto both sides of the web.

An advantage of the present invention is that the device and process produce a polymer impregnated paper with superior resistance to oil and grease.

A further advantage of the present invention is that the web may be impregnated as part of an on-machine process, rather than a batch process.

A further advantage is that the invention eliminates the subsequent curing or drying steps required for resinous compounds or aqueous polymeric dispersions.

These and other objects, advantages, and features of this invention will be apparent from the following description.

DETAILED DESCRIPTION OF THE INVENTION

Figure 1:
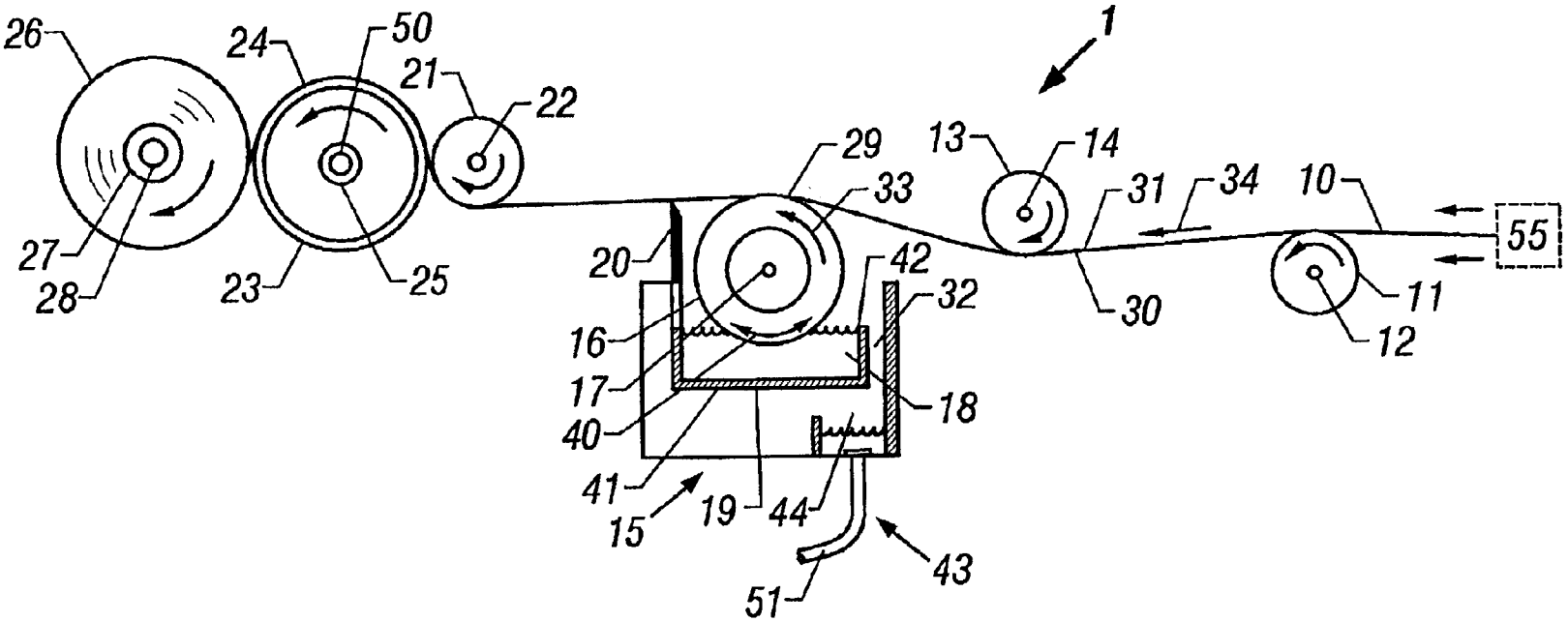
FIG. 1 is a cross-sectional view of a preferred embodiment of the polymer impregnation device and process.
Figure 2:
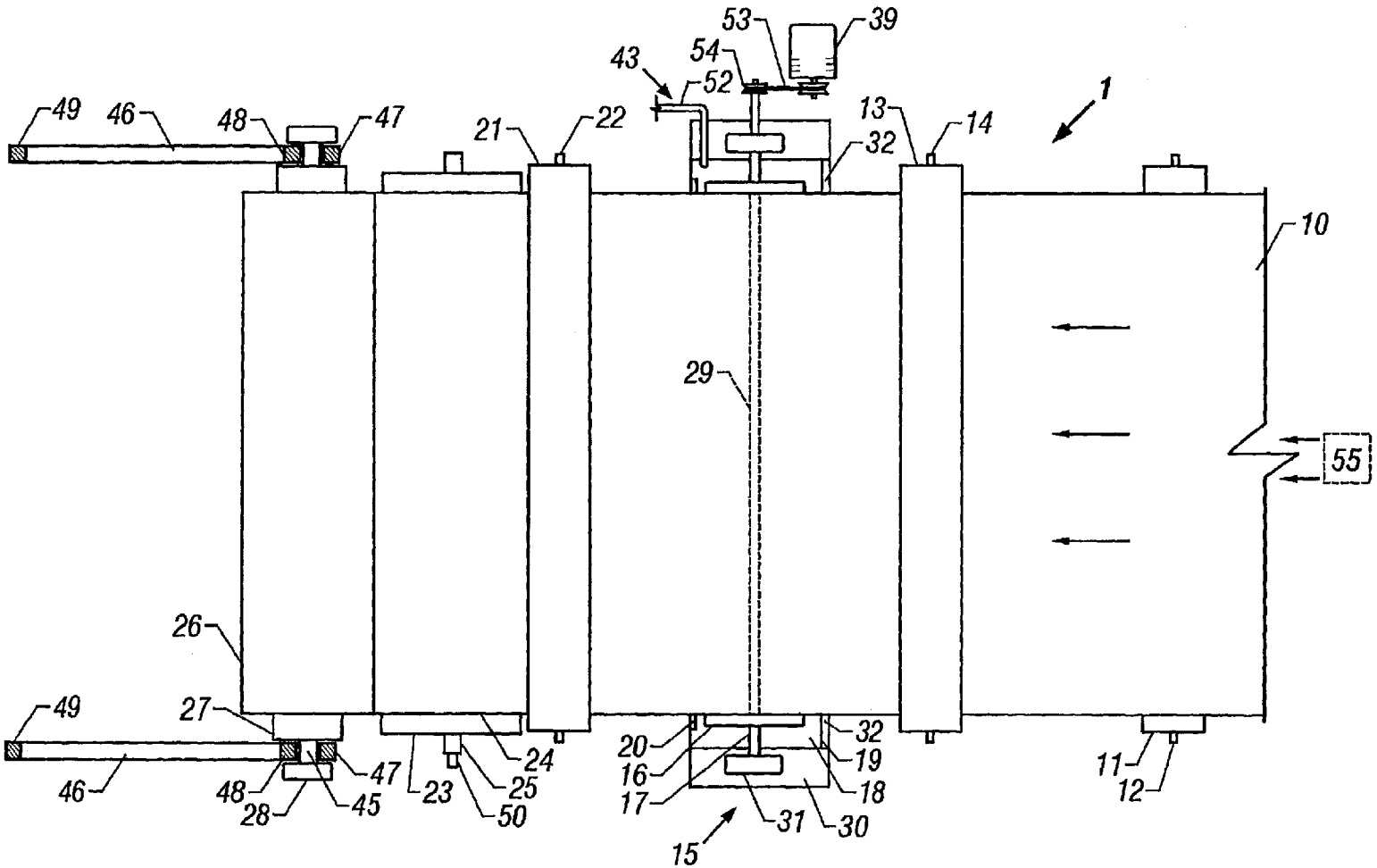
FIG. 2 is a plan view of a preferred embodiment of the polymer impregnation device and process.
Figure 3:
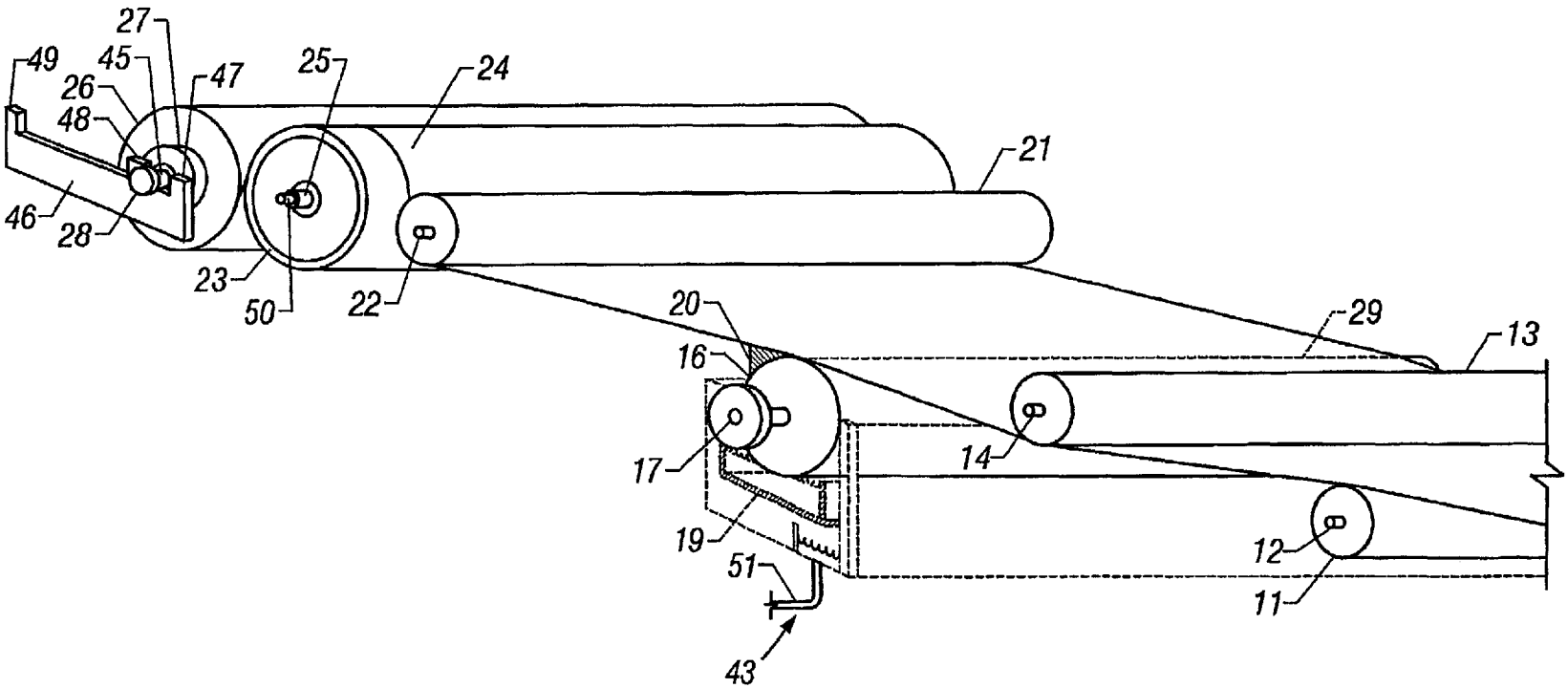
FIG. 3 is a perspective view of a preferred embodiment of the polymer impregnation device and process with the details of the polymer applicator assembly removed.

With reference to FIGS. 1, 2, and 3, a preferred embodiment of the polymer impregnation device 1 will now be described. Device 1 includes as part of an on-machine process an ordinary paper web 10 composed of cellulose or synthetic fibers (including any additives, such as clays, dyes, fillers, and other substances common in the art), polymer applicator 15, hot reel 23, and winding reel 26. Web 10, which has a first side 30 and second side 31, is created through a series of traditional paper manufacturing processes 55 located upstream of the subject invention. After web 10 has been generated, first guide roller 11 and second guide roller 13, which are rotatably mounted on first guide roller axis 12 and second guide roller axis 14, respectively, may be optionally used to guide web 10 with web velocity 34 to polymer applicator 15.

Referring to FIG. 1, polymer applicator 15 comprises molten polymer 18, polymer trough 19, and applicator roller 16. Molten polymer 18 is any synthetic, straight-chained, saturated hydrocarbon capable of being in molten form, but which exists in a solid state at room temperature (approximately 60–80 degrees Farenheit). In one preferred embodiment, web 10 is impregnated with molten C33, which is a paraffin-free polymer with a molecular chain length of 33 that is available commercially as Clariant Licolub XL 165 KB.

One of the advantages of using C33 and like materials is that the polymer, once applied, requires no further curing or drying step, unlike resinous compounds or aqueous polymeric dispersions. Resinous compounds are required to be cured using heat or other means. Similarly, with aqueous polymeric dispersions, the water in which the polymer is dissolved must be evaporated off of the web. Therefore, a process that uses either a resinous compound or an aqueous polymeric dispersion requires a subsequent curing or drying step after the polymer is applied to web 10.

The present invention requires no such subsequent step. Once the polymer cools to a temperature below its melting point, the polymer is set on web 10 and the manufacturing process is at an end. In this respect, the present invention greatly enhances the efficiency of the specialty paper manufacturing process by conserving time and resources.

Molten polymer 18 is temporarily contained in polymer trough 19 with heating means 41 for maintaining the temperature of molten polymer 18 above its melting point. In FIG. 1, heating means 41 is shown as a steam jacket, which is a hollow cavity in the walls of polymer trough 19 adapted for receiving an envelope of steam. However, heating means 41 may also include a coil heater, electrical wraps, steam tracing, or other means suitable for maintaining molten polymer 18 above its melting point.

Polymer trough 19 may optionally be equipped with polymer recirculation means 32, comprising overflow weir 42 for allowing molten polymer 18 to escape polymer trough 19, polymer capture basin 44, and return means 43 for returning molten polymer 18 from polymer capture basin 44 to polymer trough 19. Polymer recirculation means 32 may also comprise heating means 41 in order to maintain the temperature of molten polymer 18 above its melting point. In a preferred embodiment, return means is a gravity downleg 51 that drains molten polymer 18 from polymer capture basin 44 into a day tank (not shown), and a submersible pump (also not shown) in the day tank that returns molten polymer 18 to polymer trough 19 through return hose 52, as depicted in FIG. 2. In this manner, polymer recirculation means 32 as described above helps maintain the purity of molten polymer 18 and reduces the amount of polymer that is wasted.

Applicator roller 16 is rotatably suspended between web 10 and molten polymer 18 on applicator roller axis 17, which is further attached to applicator roller spindle 31 and mounting plate 30. Applicator roller 16 has a tangential velocity 33, which may be imparted by applicator roller motor 39 through belt 53 attached to pulley 54. Tangential velocity 33 may be identical to or different from web velocity 34. As will be more readily understood from the following paragraphs, the advantage of giving applicator roller 16 a tangential velocity 33 different from web velocity 34 is that the amount of molten polymer 18 deposited onto web 10 can be increased or decreased to suit the needs of the manufacturer.

Applicator roller 16 further comprises a polymer contact region 40 and a web contact region 29. Polymer contact region 40 of applicator roller 16 is at least partially immersed in molten polymer 18. Web contact region 29 is at least partially in contact with web 10.

The surface area of web contact region 40 may be increased or decreased by changing the position of optional second guide roller 13 with respect to applicator roller 16. For example, in the embodiment shown in FIG. 1, lowering second guide roller 13 with respect to applicator roller 16 will increase the angle at which web 10 approaches applicator roller 16 and thereby cause a greater portion of web 10 to be in contact with applicator roller 16 at a given time. By increasing or decreasing the surface area of web contact region 40, the user can increase or decrease the amount of molten polymer 18 applied to web 10, which ultimately affects the extent of wicking of molten polymer 18 into web 10.

The amount of molten polymer 18 applied to web 10 can also be increased or decreased by increasing or decreasing the tension present in web 10 at applicator roller 16. A higher degree of tension will cause more molten polymer 18 to be forced into web 10, while a lesser degree of tension will cause web 10 to reject more molten polymer 18.

The function of polymer applicator 15 can be readily understood from the following description. As applicator roller 16 rotates with tangential velocity 33, the surface tension and adhesive qualities of molten polymer 18 permit molten polymer 18 to be transferred along the surface of applicator roller 16 from polymer contact region 40 to web contact region 29. When molten polymer 18 on the surface of applicator roller 16 reaches web contact region 29, a quantity of molten polymer 18 is deposited onto the surface of web 10 moving at web velocity 34. Once molten polymer 18 contacts at least one of first side 30 or second side 31 of web 10, molten polymer 18 begins to wick throughout web 10 and coat the cellulose or synthetic fibers.

In a preferred embodiment, tangential velocity 33 of applicator roller 16 is less than one half that of web velocity 34, such that frictional resistance is generated between web 10 and applicator roller 16 in order to create a wiping effect. This wiping effect allows a greater amount of molten polymer 18 to be deposited onto web 10, which is moving at a greater velocity than applicator roller 16, than in the situation where web velocity 34 matches tangential velocity 33. However, the present invention contemplates the scenario in which web velocity 34 equals tangential velocity 33 as well as the scenarios in which tangential velocity 33 is greater or lesser than web velocity 34.

In an alternative embodiment, polymer applicator 15 can be modified to deposit molten polymer 18 onto both sides of web 10. Those skilled in the art will realize that this double deposition can be achieved in a number of ways, including the addition of a second polymer trough and a second applicator roller suspended in a manner such that the second applicator roller deposits molten polymer 18 onto the side of web 10 that is opposite from applicator roller 16 and polymer trough 19. Another way to accomplish a double deposition of molten polymer 18 would be to create a duplicate of polymer applicator 15 and position the duplicate polymer applicator in a manner such that the duplicate polymer applicator deposits molten polymer 18 on the opposite side of web 10 from that treated by polymer applicator 15. This latter application method could be accomplished using a series of guide rollers after web 10 has passed polymer applicator 15 in order to reorient web 10 and position the untreated side of web 10 such that it is amenable to treatment by the duplicate polymer applicator.

After molten polymer 18 has been applied by polymer applicator 16, web 10 passes optional distributing means 20, which evenly distributes molten polymer 10 onto the surface of web 10 and removes any excess polymer. In the preferred embodiment as shown in FIG. 1, distributing means 20 is a doctoring blade. However, distributing means may also be an air knife, a plurality of scraping knives or any other means suitable for the removal of excess polymer.

After molten polymer 18 has been applied to web 10 and after molten polymer 18 has been evenly distributed by optional distributing means 20, web 10 encounters hot reel 23, which is rotatably mounted on axis 25. Hot reel 23 is heated using hot reel heating means 50 to a temperature above the melting point of molten polymer 18, so as to maintain molten polymer 18 above its melting point and thereby encourage wicking of molten polymer 18 into web 10.

In the preferred embodiment shown in FIGS. 1, 2, and 3, hot reel 23 is a polished metal drum heated to a temperature above the melting point of molten polymer 18. Hot reel heating means 50 is shown as a steam injection port for the introduction of steam into the cavity of hot reel 23. A siphon (not shown) may also be located near the steam injection port to facilitate the removal of condensate from the interior walls of hot reel 23, thereby preventing hot reel 23 from filling with water. Hot reel heating means 50 may also include adaptations to hot reel 23 to allow it to be heated by blowing hot air, filling with hot water, or any other means suitable for delivering heat to hot reel 23.

If C33 is used with device 1, then the temperature of hot reel 23 should be at least 160 degrees Fahrenheit and preferably 200 degrees Fahrenheit. If a polymer other than C33 is used with device 1, then the temperature of hot reel 23 should be above the melting point of the polymer selected. As a general principle, the higher the temperature of hot reel 23, the longer molten polymer 18 will remain in a molten state and the greater the extent of wicking of molten polymer 18 into web 10. Therefore, by controlling the temperature of hot reel 23, the degree of wicking can be increased or decreased.

The amount of wicking that occurs at hot reel 23 can be manipulated by raising or lowering the temperature of molten polymer 18 while molten polymer 18 is in polymer trough 19. A higher temperature at polymer trough 19 will maintain the temperature of the polymer above its melting point for a longer period of time after application and thereby increase the amount of wicking that occurs upon contact with hot reel 23. This embodiment with a higher temperature at polymer trough 19 produces a paper with cellulose or synthetic fibers that are more completely permeated with molten polymer 18. A lower temperature at polymer trough 19 will result in the temperature of molten polymer 18 being closer to its melting point and thereby reduce the amount of wicking that occurs before web 10 encounters hot reel 23. This embodiment with a lower temperature at polymer trough 19 will produce a paper with cellulose or synthetic fibers that are permeated to a minimal depth.

The amount of wicking that occurs at hot reel 23 can also be controlled by varying the amount of surface contact that web 10 has with hot reel 23. The longer web 10 remains in contact with hot reel 23, the longer molten polymer 18 remains above its melting point and the greater the amount of wicking of molten polymer 18 into web 10.

In this regard, hot reel 23 further comprises a hot reel contact region 24, the surface area of which can be increased or decreased depending on the position of hot reel 23 relative to polymer applicator 15 and winding reel 26. The surface area of hot reel contact region 24 can also be increased or decreased by the optional use of third guide roller 21 rotatably mounted on third guide roller axis 22 as depicted in FIGS. 1, 2, and 3. By changing the position of third guide roller 21 with respect to hot reel 23, the surface area of hot reel contact region 24 can be increased or decreased.

After web 10 passes hot reel 23, it is transferred to winding reel 26, which is rotatably mounted on winding reel axis 45 and comprises winding core 27 and optional winding reel guides 28. Web 10 winds about winding core 27 until winding reel 26 is full. During the time that web 10 is winding onto winding reel 26, molten polymer 18 continues to wick into web 10 until the temperature of molten polymer 18 drops below its melting point. If the temperature of molten polymer 18 has not dropped below its melting point by the time winding reel 26 is full, winding reel 26 may be allowed to sit until the molten polymer 18 cools below its melting point and wicking has actually or substantially ceased.

In a preferred embodiment, winding reel axis 45 is journaled on rails 46 between forward rail stops 47 and retractable rail stops 48. Once the storage capacity of winding reel 26 becomes exhausted, retractable rail stops 48 can be retracted and winding reel 26 can be rolled back against aft rail stops 49 to allow a second winding reel 26 to be positioned to receive web 10 from hot reel 23. While winding reel 26 is being rolled back, winding reel axis 45 remains properly positioned between rails 46 due to winding reel guides 28. Winding reel 26 resting against aft rail stops 49 can then be processed on another device, transported to storage, or loaded for shipping.

In an alternative embodiment of device 1, hot reel 23 is replaced with a cold reel or multiple cold rolls to limit the extent of wicking of molten polymer 18 into web 10. After molten polymer 18 has been applied by polymer applicator 15 and after wicking has commenced, web 10 encounters the cold reel (or cold rolls) with a temperature cooler than the melting point of molten polymer 18. Contact with a cold surface(s) in this manner cools or solidifies molten polymer 18 and thereby either retards or ceases further wicking of molten polymer 18 into web 10. The temperature of the cold reel or cold rolls can be varied in order to achieve the degree of wicking desired by user or required of the resultant paper product.

In the embodiment described above, the cold reel or cold rolls are cooled by a cooling means (not shown). Cooling means may include filling the cold reel with chilled air, chilled water, or any other means suitable for lowering the temperature of molten polymer 18.

Another alternative embodiment of device 1 involves the optional use of cold air blowers (not shown) in place of or in conjunction with hot reel 23 (or cold reel or cold rolls in the alternative). In this manner, the application of cold air to web 10 will reduce the temperature of molten polymer 18 and thereby limit the degree of wicking.

The present invention also contemplates a method for making a polymer impregnated paper using the device described above. The method involves the steps of applying molten polymer 18 to at least one side of web 10 in a manner such that molten polymer 18 wicks into web 10, rolling web 10 across hot reel 23 to maintain molten polymer 18 above its melting point, winding web 10 onto winding reel 26, and allowing molten polymer 18 to further wick into web 10 while cooling to a temperature below its melting point.

In a preferred embodiment, molten polymer 18 is applied using polymer applicator 15. The process includes the steps of containing molten polymer 18 in polymer trough 19, providing applicator roller 16 with polymer contact region 40 and web contact region 29, suspending applicator roller 16 in a manner such that polymer contact region 40 contacts molten polymer 18 contained in polymer trough 19 and web contact region 29 contacts web 10, and rotating applicator roller 16 such that molten polymer 18 adheres to applicator roller 16 before being deposited onto web 10 so as to commence wicking.

The present invention also includes a polymer impregnated paper manufactured by the process described in the above paragraphs. The resultant paper has an improved and superior resistance to oil and grease due to the permeation of molten polymer 18 through the cellulose or synthetic fibers. The greater the depth of penetration of molten polymer 18 into web 10, the greater the resistance that the polymer impregnated paper will have to the migration of grease or oil emanating from food contained within the paper. Additionally, the polymer can be selected so that a specific melting point can be achieved. This selectivity is not available with paraffin wax.

There are, of course, other alternate embodiments that are obvious from the foregoing descriptions of the invention, which are intended to be included within the scope of the invention, as defined by the following claims.

What is claimed is:

1. A device for impregnating a web of fibers, including cellulose or synthetic fibers and any additives thereto, said web having a first side, and a second side, said device comprising:

(1) a polymer applicator, said polymer applicator being in contact with said first side, said polymer applicator further comprising:
  (a) a molten polymer which is substantially non-resinous and non-aqueous, said polymer existing in a solid state at room temperature;
  (b) an applicator roller for depositing said molten polymer onto said web, said applicator roller being capable of having a tangential velocity;
  (c) a polymer trough, said polymer trough disposed below said applicator roller and capable of maintaining said molten polymer above said melting point;

(2) a hot reel for maintaining said molten polymer above its melting point after application of said molten polymer onto said web, said hot reel being in contact with at least one of said first side or said second side; and (3) a winding reel, said winding reel being positioned to receive said web from said hot reel and store said web while said molten polymer cools on said web to a temperature below said melting point.

2. The device for impregnating a web of fibers described in claim 1, said device further comprising a distributing means for evenly distributing said molten polymer on said web and for removing excess molten polymer, said distributing means being located between said applicator roller and said hot reel.

3. The device of claim 2, wherein said distributing means is selected from the group consisting of a doctoring blade, an air knife, or a plurality of scraping knives.

4. The device for impregnating a web of fibers as described in claim 1, wherein said polymer trough further comprises a polymer recirculation means.

5. The device for impregnating a web of fibers as described in claim 1, wherein said polymer applicator further comprises a second applicator roller, said second applicator roller being disposed in a manner such that said second applicator roller contacts said second side of said web and applies said molten polymer to said second side of said web while said applicator roller applies said molten polymer to said first side of said web.

6. The device for impregnating a web of fibers as described in claim 1, wherein it is capable of moving said web at a velocity greater than said tangential velocity of said applicator roller.

7. The device for impregnating a web of fibers as described in claim 1, wherein said web is one received from a traditional paper manufacturing process and is capable of flowing uninterrupted to said device from said traditional paper manufacturing process.

8. A device for impregnating a web of fibers, including cellulose or synthetic fibers and any additives thereto, said web having a first side, and a second side, said device comprising:

(1) a polymer applicator, said polymer applicator being in contact with said first side or said second side, said polymer applicator further comprising:
  (a) a molten polymer which is substantially non-resinous and non-aqueous, said polymer being a solid state at room temperature;
  (b) an applicator roller for depositing said molten polymer onto said web, said applicator roller being capable of having a tangential velocity;
  (c) a polymer trough, said polymer trough disposed below said applicator roller and capable of maintaining said molten polymer above said melting point;

(2) a cooling means for cooling said molten polymer thereby being capable of limiting any wicking of said molten polymer when said device is in use, said cooling means being in contact with at least one of said first side or said second side; and (3) a winding reel, said winding reel being positioned to receive said web from said cooling means.

9. The device for impregnating a web of fibers as described in claim 8, wherein said cooling means is selected from the group consisting of a cold reel, cold rolls, and cold air blowers.

10. A method for impregnating a web of fibers, including cellulose or synthetic fibers and any additives thereto, said web having a first side and a second side and a web velocity, said method comprising the steps of:

(1) applying a molten polymer to said first side of said web, which polymer is substantially non-resinous and non-aqueous and which polymer is a solid at about room temperature;

(2) rolling said web across a hot reel such that said molten polymer remains in the molten state such that said molten polymer at least partially penetrates said web and wicking of said molten polymer into said web occurs;

(3) winding said at least partially penetrated web onto a winding reel; and (4) allowing said molten polymer to cool to below its melting point and to further wick into said web while cooling.

11. The method for impregnating a web of fibers described in claim 10, step 1 of which further comprises the steps of:

(1) containing said molten polymer in a polymer trough;

(2) providing an applicator roller, said applicator roller having a polymer contact region, a web contact region, and a tangential velocity;

(3) suspending said applicator roller in a manner such that said polymer contact region contacts said molten polymer contained in said polymer trough and said web contact region contacts said web; and (4) rotating said applicator roller such that said molten polymer adheres to said applicator roller before being deposited onto said web.

12. The method for impregnating a web of fibers described in claim 10, wherein said method further comprises the steps of receiving said web from a traditional paper manufacturing process and treating said web immediately thereafter using said method.

13. The method for impregnating a web of fibers described in claim 11, wherein said method further comprises the steps of receiving said web from a traditional paper manufacturing process and treating said web immediately thereafter using said method.

14. The method for impregnating a web of fibers described in claim 10, said method further comprising the step of distributing said molten polymer on said web and removing excess molten polymer from said web with a distributing means, said distributing means being located between said applicator roller and said hot reel.

15. The method for impregnating a web of fibers described in claim 11, said method further comprising the step of distributing said molten polymer on said web and removing excess molten polymer from said web with a distributing means, said distributing means being located between said applicator roller and said hot reel.

16. The method of claim 14, wherein said distributing means is selected from the group consisting of a doctoring blade, an air knife, or a plurality of scraping knives.

17. The method of claim 15, wherein said distributing means is selected from the group consisting of a doctoring blade, an air knife, or a plurality of scraping knives.

18. The method for impregnating a web of fibers as described in claim 11, wherein said polymer trough further comprises a polymer recirculation means.

19. The method for impregnating a web of fibers as described in claim 11, wherein step (2) of said method further comprises the steps of providing a second applicator roller, said second applicator roller being disposed in a manner such that said second applicator roller contacts said second side of said web, and applying said molten polymer to said second side of said web while said applicator roller applies said molten polymer to said first side of said web.

20. The method for impregnating a web of cellulose fibers as described in claim 11, wherein said web velocity differs from said tangential velocity of said applicator roller.

21. A method for impregnating a web of fibers, including cellulose or synthetic fibers and any additive thereto, said web having a first side and a second side and a web velocity, said method comprising the steps of:

(1) applying a molten polymer to said first side or said second side of said web such that said molten polymer at least partially penetrates said web, which polymer is substantially non-resinous and non-aqueous and which is a solid at about room temperature;

(2) exposing said web to a cooling means such that said molten polymer is cooled before substantial wicking of said polymer occurs; and (3) winding said web onto a winding reel.

22. The method for impregnating a web of fibers described in claim 21, step 1 of which further comprises the steps of:

(1) containing said molten polymer in a polymer trough;

(2) providing an applicator roller, said applicator roller having a polymer contact region a web contract region, and a tangential velocity;

(3) suspending said applicator roller in a manner such that said polymer contact region contacts said molten polymer contained in said polymer trough and said web contact regions contacts said web; and (4) rotating said applicator roller such that said molten polymer adheres to said applicator roller before being deposited onto said web.

23. The method for impregnating a web of fibers described in claim 21, wherein said cooling means is selected from the group consisting of a cold reel, cold rolls, or cold air blowers.

24. A polymer impregnated paper produced by a method for impregnating a web of fibers, including cellulose or synthetic fibers and any additives thereto, said web having a first side and a second side and a web velocity, said method comprising the steps of:

(1) applying a molten polymer to said first side of said web, which molten polymer is substantially non-resinous and non-aqueous and which is a solid at about room temperature;

(2) rolling said web across a hot reel such that said molten polymer remains in the molten state such that said molten polymer at least partially penetrates said web and wicking of said molten polymer into said web occurs (3) winding said at least partially penetrated web onto a winding reel; and (4) allowing said molten polymer to cool to below its melting point and to further wick into said web while cooling;

wherein said fibers of said polymer impregnated paper are permeated by said molten polymer and, as a result, said polymer impregnated paper has improved resistance to oil and grease.

25. The polymer impregnated paper of claim 24 produced by the method described therein, step 1 of which further comprises the steps of:

(1) containing said molten polymer in a polymer trough;

(2) providing an applicator roller, said applicator roller having a polymer contact region, a web contact region, and a tangential velocity;

(3) suspending said applicator roller in a manner such that said polymer contact region contacts said molten polymer contained in said polymer trough and said web contact region contacts said web; and (4) rotating said applicator roller such that said molten polymer adheres to said applicator roller before being deposited onto said web;

wherein said fibers of said polymer impregnated paper are permeated by said molten polymer and, as a result, said polymer impregnated paper has improved resistance to oil and grease.

* * * * *